United States Patent [19]

Eklund

[11] Patent Number: 4,679,524

[45] Date of Patent: Jul. 14, 1987

[54] ARRANGEMENT FOR WEB COATING

[75] Inventor: Dan Eklund, Viherlaaksontie, Finland

[73] Assignee: Oy Wartsila Ab, Helsinki, Finland

[21] Appl. No.: 718,826

[22] Filed: Apr. 2, 1985

Related U.S. Application Data

[63] Continuation of Ser. No. 537,734, Sep. 30, 1983, abandoned, which is a continuation-in-part of Ser. No. 307,868, Oct. 2, 1981, abandoned.

[30] Foreign Application Priority Data

Oct. 8, 1980 [FI] Finland ..... 803184
May 5, 1983 [FI] Finland ..... 831672

[51] Int. Cl.[4] ..... B05C 11/04; B05C 3/15; B05C 3/18

[52] U.S. Cl. ..... 118/122; 118/126; 118/405; 118/407; 118/413

[58] Field of Search ..... 118/122, 407, 413, 410, 118/412, 405, 259, 126; 101/366, 364

[56] References Cited

U.S. PATENT DOCUMENTS

| | | | |
|---|---|---|---|
| 1,458,591 | 6/1923 | Olson | 118/407 |
| 2,977,247 | 3/1961 | Lutz | 118/262 X |
| 3,179,536 | 4/1965 | Marjinek | 118/407 X |
| 3,518,964 | 7/1970 | Nagler | 118/126 X |
| 4,063,531 | 12/1977 | Zitzow | 118/122 |
| 4,233,930 | 11/1980 | Wohlfeil | 118/122 |
| 4,250,211 | 2/1981 | Damrau et al. | 427/356 |
| 4,257,343 | 3/1981 | Kullander | 118/50 |

*Primary Examiner*—John P. McIntosh
*Attorney, Agent, or Firm*—McAulay, Fields, Fisher, Goldstein & Nissen

[57] ABSTRACT

An apparatus for coating a vertically travelling web comprises a vertical coating chamber defined by the web, a pair of side walls, a back wall spaced from the web, and a flexible blade applied against the web and forming a top closure of the coating chamber. There is a back-up member at the opposite side of the web forming a coating nip together with the flexible blade, through which nip the web passes. A slot at the bottom of the coating chamber forms a web entrance of the coating chamber. The width of the slot and the supply of coating substance to the coating chamber are so adapted to the speed of the web and to the viscosity of the coating substance, that only a small amount of coating substance flows downwardly through the slot during normal operation of the apparatus. The side walls of the coating chamber provide means for substantially closing the coating chamber. A flow regulating member may be arranged crosswise to the web and at a distance therefrom to form between itself and the web a duct converging in the travelling direction of the web. The duct has an average height perpendicularly to the web which is smaller than the thickness of the coating substance layer that would adhere to the travelling web in the absence of the flow regulating member.

17 Claims, 6 Drawing Figures

1
16
4
2
3
8b
7
8c
13
8
16
9
6
10
11
5
12
14
1

ARRANGEMENT FOR WEB COATING

This application is a continuation of Ser. No. 537,734 filed Sept. 30, 1983, now abandoned which in turn is a continuation-in-part of Ser. No. 307,868 filed Oct. 2, 1981, now abandoned.

FIELD OF THE INVENTION

The invention relates to an arrangement for one-sided or two-sided coating of a basically upwardly moving web, for instance a paper web, by providing an excess supply of coating substance onto the web and evening the coating substance sticking thereto by pulling the web through a coating nip formed by a flexible coating blade and a back-up member.

BACKGROUND OF THE INVENTION

In web coating arrangements, in which the web is pulled upwards through a nip formed by a blade or the like and a back-up member, the spreading of coating substance onto the web usually takes part below the nip by means of a spreading apparatus. In a known arrangement the spreading apparatus comprises two rolls forming a nip through which the web is pulled. The coating substance is supplied onto at least one of these rolls, the applicator roll, wherefrom it is transferred to and spread onto the web. At high web speeds, one difficulty is due to web slip in the spreading nip because the applicator roll moves slower than the web. This causes uneven coating substance transfer to the web. Another known coater construction comprises spreading nozzles in lieu of applicator rolls. However, with this arrangement it is difficult to spread the coating substance uniformly on the web. A common feature of both these known constructions is that, in the spreading phase, relatively great amounts of surplus coating substance are removed from the web and from the spreading unit. This excess amount has to be pumped back to the spreading point, and this forms an extra, uneconomical step of the process. Further, another recycling circuit has to be provided for recycling the coating substance scraped off by the evening blade or blades. This complicates the construction and increases the manufacturing costs.

In coating units provided with a non-pressure coating applicator, that is, a coating substance applicator under atmospheric pressure, a phenomenon called barring causes problems in the form of coating layer variations in the longitudinal direction of the web, especially at high coating speeds (over 500 m/min). Exactly why barring occurs has not been completely clarified. An improved embodiment of the invention is based on the assumption that one reason for the occurrence of barring is due to non-uniform thickness of the coating layer on the web before the smoothing nip. This results in movements in the smoothing blade, and an uneven coating is produced because of these movements.

In an extrusion applicator, in which the coating substance is applied on the web under pressure, the situation is different. In applicators of this type, a fairly long smoothing gap is used in connection with the applicator for equalizing the coating substance pressure. The invention is not related to such coating methods.

OBJECT AND SUMMARY OF THE INVENTION

The object of the invention is to provide a web coating arrangement, in which the spreading of the coating substance, also at high web speeds, is carried out in a reliable and economical way and with a homogeneous and even result. An arrangement according to the invention has low manufacturing costs and the amount of recycled coating substance is minimized. This results in an improved coating economy. Also the coating substance scraped off from the web by the coating nip blades, is collected for reuse without any pumping action.

According to the invention, the web to be coated is moved past a vertical coating chamber defined by the web, a pair of side walls, a back wall spaced from the web, and a flexible blade applied against the web and forming a top closure of the coating chamber. At the opposite side of the web there is a back-up member forming a coating nip together with the flexible blade, through which nip the web passes. At the bottom of the coating chamber there is a slot forming a web entrance to the coating chamber. The coating substance supply to the coating chamber and the width of the bottom slot are so adapted to the speed of the web and the viscosity of the coating substance, that only a small amount of the coating substance flows downwardly through the slot during normal operation of the apparatus. The side walls of the coating chamber are preferably vertically adjustable, thereby providing means for substantially closing the coating chamber.

The web is in direct contact with the coating substance in the coating chamber. The moving web then carries away coating substance, which contributes to a firm adherence of coating substance all over the web surface. The excess coating substance scraped off by the coating blade is, even at high web speeds, collected in the coating chamber for immediate reuse without any pumping means. Since only a small amount of coating substance passes through the bottom slot downwards, a column of coating substance is formed in the coating chamber. This provides a large and uniform contact between the web and the coating substance. Moreover, the construction is economical as a result of the very small amount of coating substance passing down below the coating chamber. When the viscosity of the substance is optimized relatively to the web speed, no coating substance at all will flow down below the chamber. Naturally, no pumping means will then be needed for recycling the coating substance.

The coating substance level in the coating chamber can easily be adjusted by means of a preferably adjustable overflow edge or duct. The coating chamber may be provided with vertically adjustable side walls, the upper edge of which form the overflow edge. The vertical adjustement of the side walls makes it possible to use the coating chamber as a substantially closed case, which is more or less filled with coating substance. For obtaining this it is not necessary that the side walls are adjustable up to the very top of the coating chamber, because the up-going flow of coating substance following the web and the down-going return of the surplus coating substance scraped off by the flexible blade fills the top portion of the coating chamber even if the upper edge of each side wall is not very close to the top of the coating chamber. It should be noted that the coating chamber may have a length in the tranverse direction of the web of 6 . . . 8 m in a full scale coater. This means that also rather large end openings the coating chamber will nevertheless allow the coating chamber to remain substantially filled with the coating substance.

The object of an improved embodiment of the invention is to reduce the risk of barring. The additional features of this embodiment of the invention include a flow regulating member arranged crosswise to said web and at a distance therefrom and forming between itself and said web a duct converging in the travelling direction of said web and having an average height perpendicularly to said web which is smaller than the thickness of the coating substance layer that would adhere to the travelling web in the absence of said flow regulating member. This arrangement considerably decreases the thickness variations of the coating substance layer adhering to the web before the smoothing blade, as well as other disturbances, and this substantially improves the quality and uniformity of the coating.

A solution resembling the improved embodiment of the invention is shown in several prior publications. Reference is made to the following Patent Specifications: U.S. Pat. No. 3,179,536, item 28, U.S. Pat. No. 4,063,531, item 67 and item 15a, FI 55375 and SE 402 222. These known arrangements differs from the improved embodiment of the invention in that the flow regulating duct is not coverging (U.S. Pat. No. 3,179,536, FI 55375, SE 402 222 and U.S. Pat. No. 4,063,531, item 15a) and in that there is no contact between the element in question and the coating layer on the web (U.S. Pat. No. 4,063,531, item 67).

The flow regulator should preferably be at the coating substance level in the applicator. This is, however, not always absolutely necessary. The rear edge of the flow applicator should be sharp to eliminate disturbing effects on the coating.

The height of the flow regulating duct is dependent on the dry solids content and the viscosity of the coating substance. If the coating substance contains much liquid and has a low viscosity, the duct height should be reduced. In practice, the average height of the flow regulating duct should be 0.5 . . . 5 mm.

The length of the flow regulating duct in the longitudinal direction of the web can be selected relatively freely. It has been found that the duct length is not of great importance. The duct length should be at least the same as the lowest duct height. A recommendable duct length is 4 . . . 200 mm, preferably 10 . . . 100 mm.

The flow regulating duct is coverging in the longitudinal direction of the web. A suitable angle on convergence is 2° . . . 20°, preferably 4° . . . 10°. Hydrodynamic forces having a favourable effect on the uniformity of the coating layer occur due to the convergence of the duct.

To ensure that the flow regulator operates correctly, it is important that the coating substance level in the coating applicator remains basically constant. The surface-level regulation must be very accurate, if the distance between the web and the flow regulator is small. A sufficiently accurate surface-level regulation is usually obtained by providing the coating applicator with an overflow system that automatically keeps the surface level at a desired height.

In all embodiments of the invention, the width of the slot at the bottom of the coating chamber should normally not exceed 5 cm, preferably not exceed 1 cm. Then a coating substance flow downwards through the slot is easily prevented also at low web speeds.

The coating operation may favourably be carried out when the coating substance has a dynamic viscosity higher than 1 mPas. Then for instance, water soluble sizing components require just small amounts of water, which reduces the need for web drying, and thus improves the economy of the process.

The coating substance which has possibly flown down through the bottom slot is preferably collected in a tank or trough below the slot. Naturally, also the coating substance flow coming from the level regulating means of the coating chamber can be collected in the same tank or trough.

A preferred embodiment of the invention features an angle between the web and the flexible blade in the coating nip which is smaller than 40°. This makes the mounting of the blade easier and decreases the risk of web damages. Another favorable embodiment of the invention uses a roll as a back-up member in the coating nip. The roll rotates with a speed at least substantially corresponding to the web speed. This embodiment is very suitable, for example, when the web is simultaneuosly subject to size press coating and pigment coating. The same device can easily be used for normal one-side coating, also. The arrangement is applicable for low and high web speeds as well.

A suitable back-up member for the coating nip can be formed as a plate extending vertically upwards slightly above the coating nip and downwards to or past the bottom level of the collection tank or trough. The width of the plate should correspond to or exceed the web width. By this means the web is simply and firmly supported at its one side and the nip back-up member as well as the slot limiting member are formed by one single member.

In an arrangement according to the invention, the members located at opposite sides of the web may be fully or partly identical. For two-sided coating a coating chamber can be arranged at both sides of the web, preferably at the same vertical level. These chambers may be supplied with the same kind or with different kinds of coating substance. In the latter case, the slot widths and liquid level positions at both sides may be considerably different.

In order to obtain an uniform coating result, the arrangement can be provided with a load member applying an adjustable pressure on the flexible coating blade, as known per se.

BRIEF DESCRIPTION OF THE DRAWING

The invention will be described more in detail with reference to the attached drawing, in which.

DESCRIPTION OF THE PREFERRED EMBODIMENTS

Figure 1:
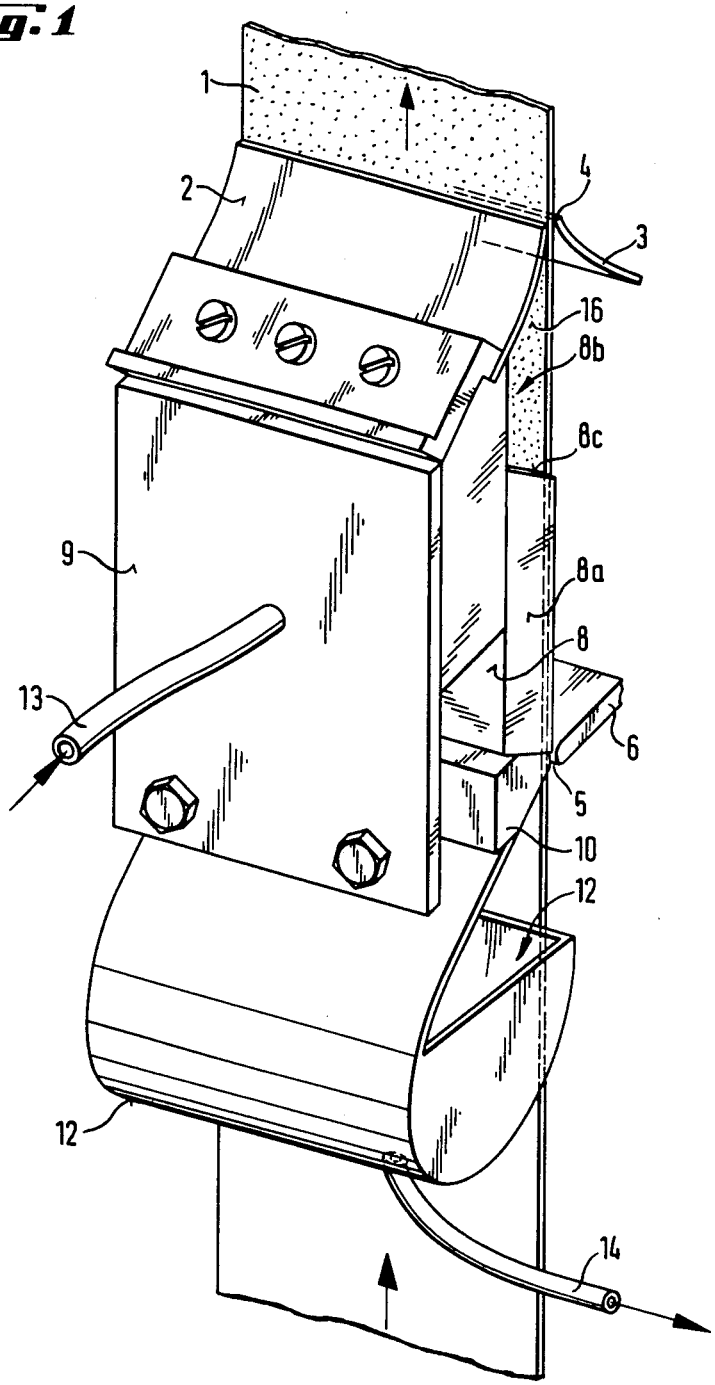
FIG. 1 is a schematic perspective view of a first embodiment of the invention, in which the web width is much reduced from what is normal in full scale coaters.
Figure 2:
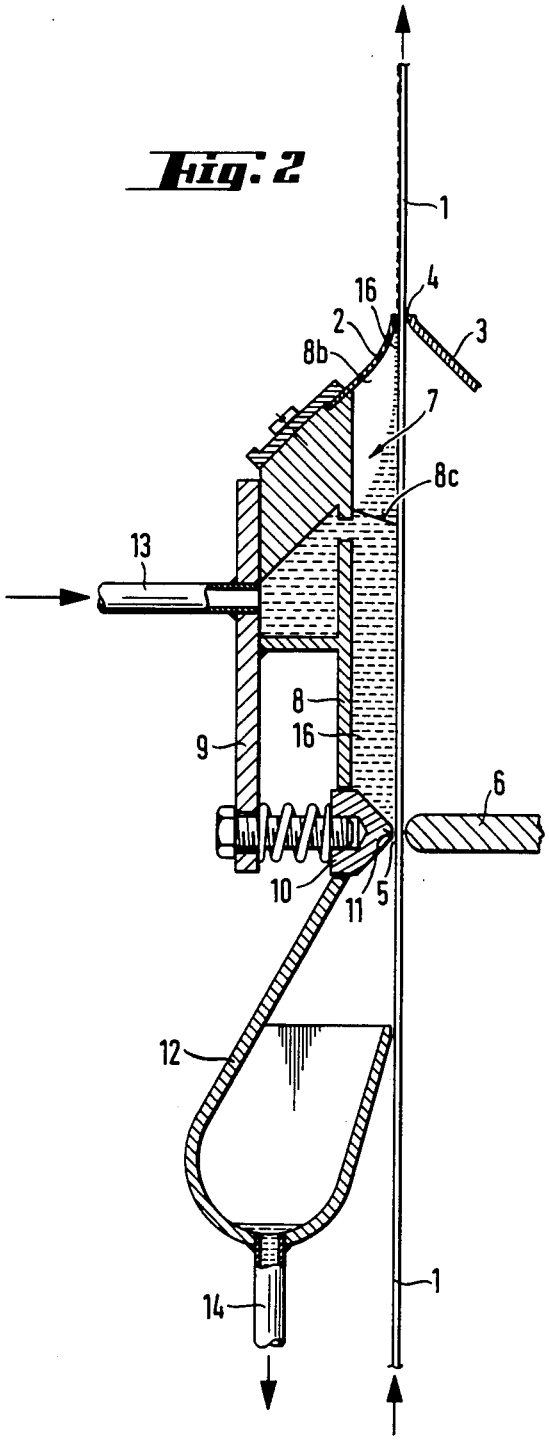
FIG. 2 is a sectional side view of the apparatus of FIG. 1.

Referring descriptively to the drawing, reference numeral 1 indicates a moving web, which is pulled through a coating nip 4 formed between a flexible blade 2 and a back-up member 3 (FIGS. 1 and 2). The running direction of the web is indicated by an arrow. A narrow slot 5 is formed below nip 4. Slot 5 is formed between a slot limiting member 6 and the edge 11 of an adjustable slot width regulator 10. The slot width is infinitely variable up to a maximum of preferably 5 cm. Back-up member 3 and limiting member 6 may be separate or combined to a single member, which may be a roll, a flexible or a rigid plate or a fixed web guide member. A coating chamber 7 is formed above slot 5. This chamber is limited by the web 1, the flexible blade 2, a back wall 8 and side walls 8*a*. The side walls 8*a* may pass beyond the side edges of the web as indicated in FIG. 1. In this case, it might be suitable to use, at that portion of the web, a properly arranged back-up member, not shown. It is in most cases more convenient to slightly reduce the distance between the side walls so that their edges seal against the web. Thereby, a narrow section at each web edge is left uncoated. The upper portion 8*b* of the coating chamber is during operation of the apparatus more or less filled with coating substance due to the action of blade 2, which scrapes off surplus coating substance and lets it flow back to the lower portion of the coating chamber.

A support plate 9 carries slot width regulator 10, which is movably suspended so as to allow adjustment of the width of slot 5. Width regulator 10 may be provided with threaded members 27 (FIG. 3) so arranged, that turning of the members causes adjustment of the width of slot 5. The slot width regulator could also have the form of a rotatable, excentrically journalled bar extending crosswise to the web.

Coating substance 16 is supplied to chamber 7 through a supply duct 13. A collecting tank 12, open against web 1, is arranged below slot 5. The small amounts of coating substance flown through slot 5 and collected in tank 12 are recycled to chamber 7 through an outlet duct 14, which via pumping means (not shown) is connected to supply duct 13. Chamber 7 is provided with means for regulating the level of coating substance contained therein. For example, coating substance may flow over the upper edge 8*c* of side walls 8*a* into tank 12. The edges 8*c* are preferably vertically adjustable.

Figure 3:
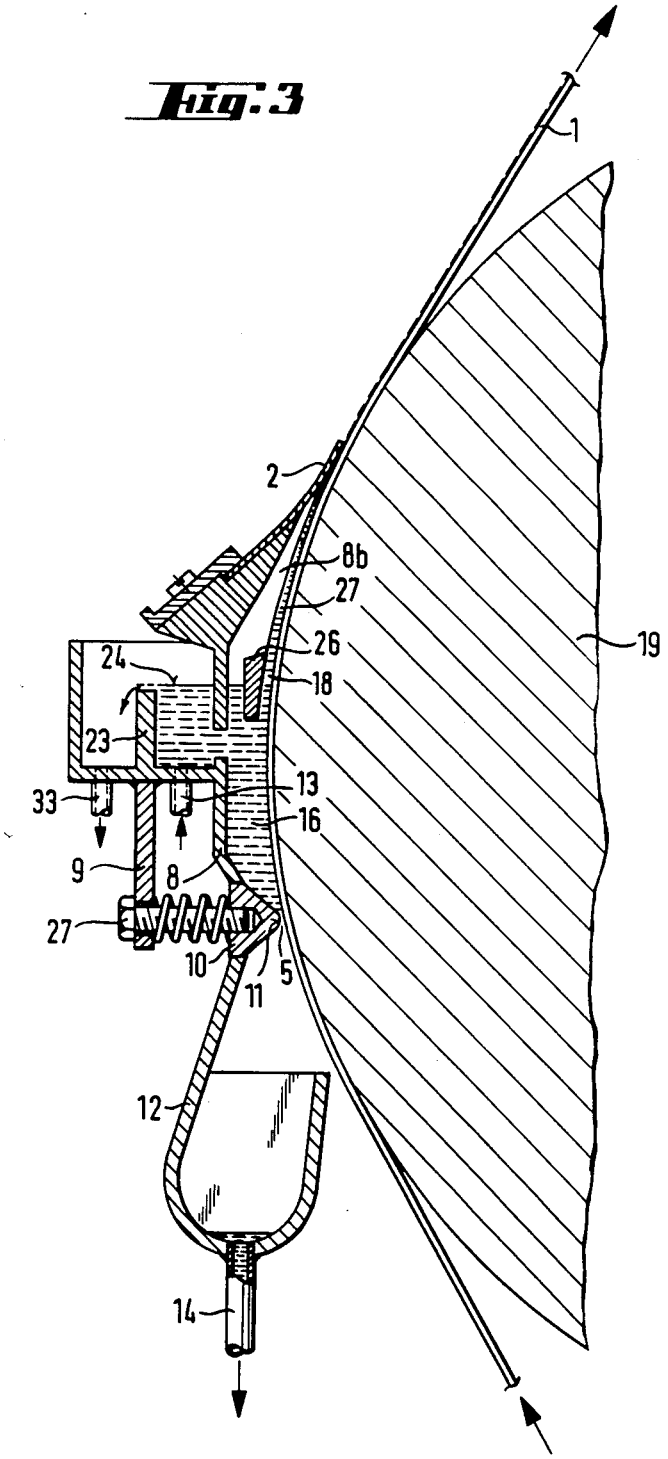
FIG. 3 is a sectional side view of a second embodiment of the invention.

The embodiment of FIG. 3 includes a roll 19, which at the same time forms the back-up member for flexible blade 2 and the limiting member for slot 5. Roll 19 is rotated in the running direction of web 1. There is an overflow wall 23 at the back of the coating applicator, keeping the level 24 of the coating substance 16 at a constant height. At this height, the coating applicator has a flow regulator 26, forming a slightly coverging duct 18 at the web. Flow regulator 26 reduces the amount 27 of coating substance following web 1 upwards into the upper portion 8*b* of the coating chamber. Layer 27 is substantially uniform in thickness, which has a favourable influence on the function of coating blade 2 and thus helps to avoid barring. The distance between flow regulator 26 and the web and preferably also the angular position of the flow regulator relative to the web are adjustable.

Figure 6:
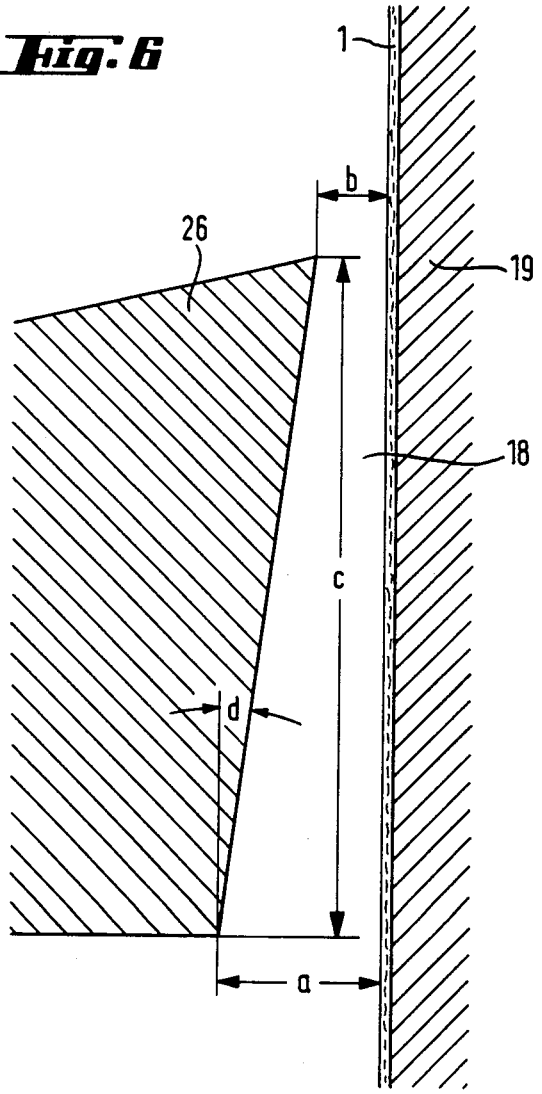
FIG. 6 is a portion of FIG. 3 shown on an enlarged scale.

Coating substance is pumped to applicator 8 through pipes 13, and coating substance flown over the overflow wall 23 is led to a recycling system through a pipe 33. The lower portions of the coating applicator of FIG. 3 are as in the other embodiments shown. The general arrangement shown in FIG. 3 can, of course, also be used as the other illustrated embodiments of the invention without flow regulator 26, and the other illustrated embodiments can be used with the improvements shown in FIG. 3. The converging duct 18 between flow regulator 26 and the web is more clearly shown in FIG. 6. The angle of convergence d is about 10°. The inlet-side duct height is a and the outlet-side duct height is b. The dimension a is in most cases 1.5 . . . 7 mm, preferably 2 . . . 4 mm. The duct length c should be greater than b and at least 4 mm, preferably 10 . . . 100 mm.

Due to the convergence of duct 18, there will be a hydrodynamic force P in the duct. Expressed as force per width-unit in the crossweb direction of the flow regulator this force can be calculated from the known formula:

$$P = \frac{6\,nU}{\tan^2 d}\,,\left[\ln m - \frac{2\,m-2}{m+1}\right],$$

where n = the viscosity of the coating substance

U = the speed of the web 1 d = the angle of convergence of the duct m = a/b (ratio of the duct height at the inlet end and at the outlet end).

The hydraulic force P has an evening effect on the coating substance layer 27, which improves the effect of the flow regulator 26.

Figure 4:
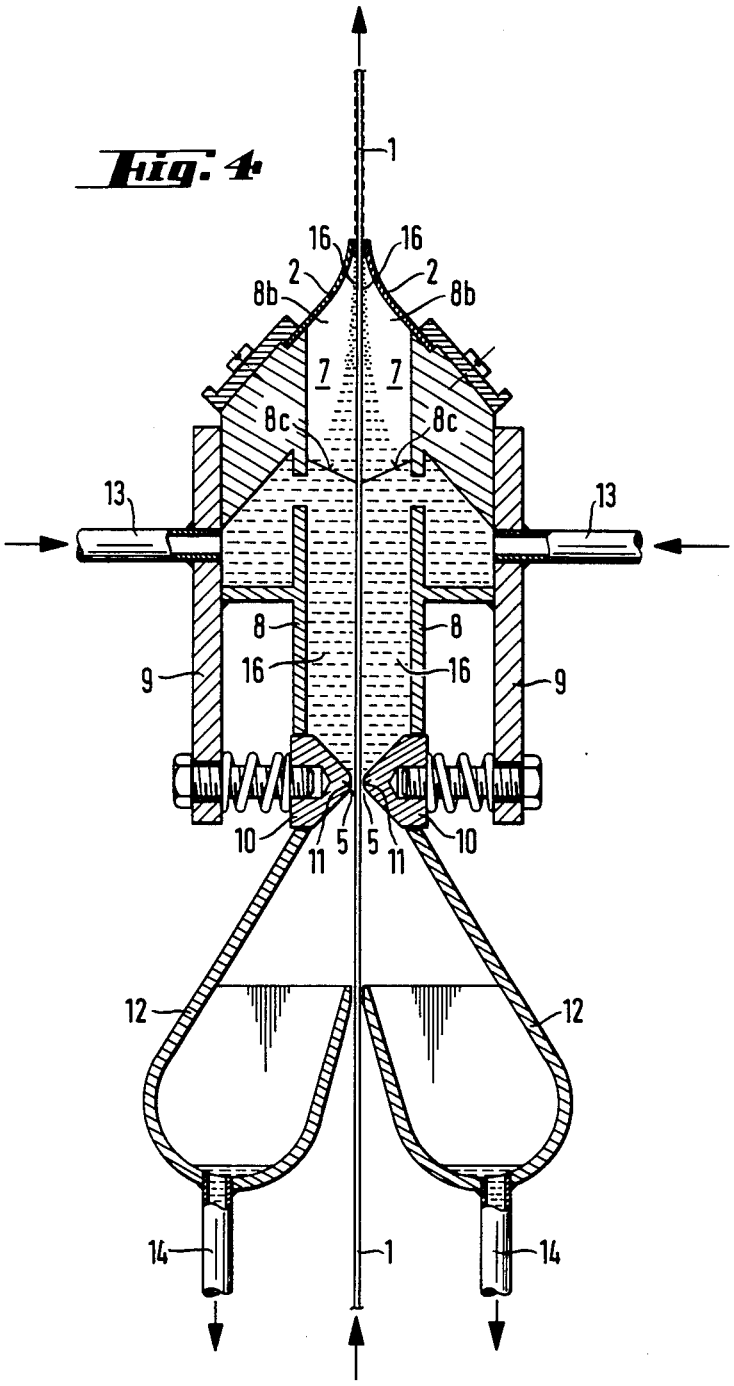
FIG. 4 is a sectional side view of a third embodiment of the invention.

The embodiment shown in FIG. 4 is basically symmetric relative to web 1. This embodiment is used for two-sided coating. It is, however, not necessary to use a symmetrical coating arrangement. If, for instance, different coating substances with different viscosity are supplied to coating chambers 7 at opposite sides of the web, the slot regulating edges 11 may be at different distances from web 1.

Collecting tank 12 is suspended at coating chamber wall 8. Tank 12 can also be formed in one piece with wall 8 by providing the latter with a long, downwards extending portion bent at its lower edge towards web 1 to form a trough. The trough or tank 12 may extend outside the side edges of web 1.

Figure 5:
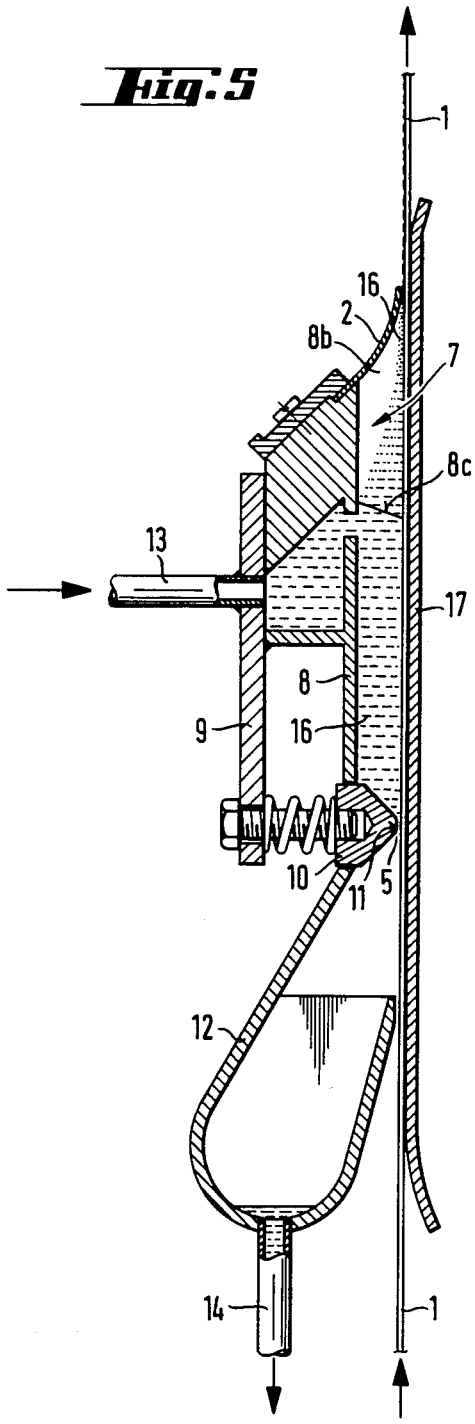
FIG. 5 is a sectional side view of a fourth embodiment of the invention.

The back-up member of coating nip 4 and the limiting member of slot 5 may be combined into a single, mainly rigid web guiding plate 17, as shown in FIG. 5.

The invention is not limited to the embodiments shown, but several modifications thereof are feasible within the scope of the claims.

I claim:

1. Apparatus for non-pressurized coating a vertically upwardly travelling web moving at a given speed comprising, in combination:

a vertical coating chamber open to atmospheric pressure and free of any seal against atmospheric pressure and provided with means for substantially closing said coating chamber to use said coating chamber as a substantially closed case while being under said atmospheric pressure and being defined by said web, a pair of side walls, a back wall spaced from said web, and a flexible blade applied against said web, said side walls of said coating chamber being vertically adjustable thereby providing said means for said closed case;

a back-up rotating roll at the opposite side of said web and forming a coating nip together with said flexible blade, through which nip said web passes above said coating chamber;

a horizontally oriented slot at the bottom of said coating chamber forming a web entrance to said coating chamber such that the web moves in a substantially vertical direction upwardly through said horizontal slot and enters said slot in a substantially vertical direction;

said slot comprising rotatable screw means forming a slot width regulator for an infinitely regulator adjustment of the width of said slot, said slot width being regulated up to 5 cm, said screw means increasing or decreasing said width of said slot upon rotating said screw means;

means for supplying a coating substance of a given viscosity to said coating chamber;

the coating substance supply to said coating chamber and the width of said slot being so adapted to said speed of said web and said viscosity of said coating substance, that only a small amount of or substantially none of said coating substance flows vertically downwardly in a direction opposite to the direction of said upwardly travelling web through said slot during normal operation of said apparatus;

said side walls including an upper edge forming overflow means determining the level of said coating substance above said slot, and said upper edge of said side walls being below said blade; and a collecting tank below said slot and separate from said coating chamber and open against said web mounted below said horizontally oriented slot to collect therein the coating substance which flows over said vertically adjustable side walls.

2. Apparatus according to claim 1, wherein said screw means include an adjustment for an infinitely adjustable slot width up to 1 cm.

3. Apparatus for non-pressurized coating a vertically travelling web moving in an upward direction open to atmospheric pressure at a given speed comprising, in combination:

a vertical coating chamber of the mainly closed type defined by said web, a pair of vertically adjustable side walls, a back wall spaced from said web, and a flexible blade applied against the web and forming a top closure of said coating chamber, and said coating chamber being open at all times and free of any seal to atmospheric pressure through portions above said side walls;

a back-up member at the opposite side of said web and forming a coating nip together with said flexible blade, through which nip said web passes, said vertically adjustable side walls providing means for substantially closing said coating chamber while maintaining the interior of said coating chamber under atmospheric pressure and below said blade;

said side walls of said coating chamber determining the level of said coating substance;

a horizontally oriented slot at the bottom of said coating chamber forming a web entrance of said coating chamber such that the web moves in a substantially vertical direction upwardly through said horizontally oriented slot and enters said slot in a substantially vertical direction;

a collecting tank separate from said coating chamber open against said web and mounted below said slot;

means for supplying the coating substance to said coating chamber, said coating substance having a given viscosity;

the coating substance supply to said coating chamber and the width of said slot being so adapted to said speed of said web and said viscosity of said coating substance, that only a small amount or substantially none of said coating substance flows directly downwardly through said slot into said collecting tank during normal operation of said apparatus;

said width of said slot being independently adjustable while maintaining said coating chamber at a fixed position relative to said backup member; and means for recycling the coating substance from said collecting tank to said coating chamber.

4. The apparatus of claim 3, wherein a roll rotating in the direction of travel of said web forms said back-up member.

5. Apparatus according to claim 3, wherein a single stationary guiding plate opposite said flexible blade and said chamber forms said back-up member.

6. The apparatus of claim 3, wherein the width of said slot does not exceed 5 cm.

7. The apparatus of claim 3, wherein the width of said slot is about 1 cm.

8. Apparatus for coating a vertically upwardly travelling web moving at a given speed comprising, in combination:

a vertical coating chamber at ambient atmospheric pressure forming a coating applicator defined by said web, a pair of side walls, a back wall spaced from said web, and a flexible blade applied against said web and forming a top closure for said coating chamber;

a back-up member confronting said flexible blade at the opposite side of said web and forming a coating nip, together with said flexible blade, through which nip said web passes;

level regulating means below said nip in the direction of travel of the web comprising said side walls and an overflow wall at the back of said coating applicator for regulating the level of coating substance in said coating chamber;

a slot at the bottom of said coating chamber forming a substantially horizontal web entrance to said coating chamber such the the web moves in a substantially vertical direction upwardly through said horizontal slot and enters thereinto in a vertical direction;

means for supplying a coating substance of a given viscosity to said coating chamber;

the coating substance supply to said coating chamber and the width of said slot being so adapted to said speed of said web and said viscosity of said coating substance, that only a small amount or substantially none of said coating substance flows vertically downwardly through said slot during normal operation of said apparatus;

a flow regulating member arranged crosswise to said web and at a distance therefrom between said slot and said nip and forming between itself and said web a slightly converging duct allowing an undirected substance flow and converging in the travelling direction of said web and having an average height perpendicular to said web which is smaller than the thickness of the coating substance layer that would adhere to the travelling web in the absence of said flow regulating member, said flow regulating member reducing the amount of coating substance following said web in the running direction thereof, said coating substance between said flow regulating member and said web being substantially uniform in thickness; and the height position of said flow regulating member is at the level of the coating substance in said coating chamber and extends above and below the fluid level of the coating substance, said flow regulating member at the height of said coating substance forming said slightly converging duct at the web, and said overflow wall keeps said coating substance in said coating chamber at a constant height at a rear side of said flow regulating member while allowing the undirected substand flow between said web and a front side of said flow regulating member facing said web.

9. The apparatus of claim 8, wherein the average height of said duct between said flow regulating member and said web is between 0.5 and 5 mm.

10. The apparatus of claim 8, wherein the length of said duct between said flow regulating member and said web, in the travelling direction of said web, is between 4 and 200 mm.

11. The apparatus of claim 8, wherein the length of said duct between said flow regulating member and said web, in the travelling direction of said web, is from 10 to 100 mm.

12. The apparatus of claim 8, wherein the length of said duct between said flow regulating member and said web in the travelling direction of said web, is at least as great as the smallest height of said duct.

13. The apparatus of claim 8, wherein said flow regulating member has a sharp edge forming the upper end limit at one side of the duct formed between said flow regulating member and said web.

14. The apparatus of claim 8, wherein the angle of the convergence of the duct between said flow regulating member and said web is between 2° and 20°.

15. The apparatus of claim 8, wherein the angle of the convergence of the duct between said flow regulating member and said web is from 4° to 10°.

16. Apparatus according to claim 8, wherein said flow regulating member extends into said coating substance so that it extends from a position outside the coating substance above thereof and below thereof and is free of contact with said web.

17. Apparatus for two-sided non-pressurized coating under atmospheric pressure of a vertically upwardly travelling web of paper or the like comprising:

a pair of vertical coating chambers open to atmospheric pressure and provided with means for substantially closing said chambers for their use as substantially closed cases while being under atmospheric pressure separated by said web and containing coating material for each side of said web, said chambers being open to atmospheric pressure and having the coating materials in each of said chambers isolated from each other;

said chambers each having in their upper ends a flexible blade forming a coating nip therebetween through which said web passes;

a horizontally oriented entry slot for said web below said chambers formed by slot limiting members mounted on said chambers such that said web moves in a substantially vertical direction upwardly through said horizontal slot and enters said slot in a substantially vertical direction;

said slot limiting members comprising movable members forming a slot width regulator for adjustment of the width of said slot on each side of the web;

overflow members determining the level of said coating substance above said slot;

at least one collecting tank below said entry slow and open against said web;

means for supplying a coating substance to said chambers; and the coating substance supply to said coating chamber and the width of said slot being so adapted to the speed of said web and to the viscosity of said coating substance, that only a small amount or substantially none of said coating substance flows directly downwardly through said slot during normal operation of said apparatus in a direction opposite to the direction of said upwardly moving web to thereby decrease the thickness variations of the coating substance layer adhering to said web.

* * * * *